US005421035A

United States Patent [19]

Klose et al.

[11] Patent Number: 5,421,035

[45] Date of Patent: Jun. 6, 1995

[54] PROTECTIVE HELMET

[75] Inventors: Odo Klose, Wuppertal; Günther Schulz, Remscheid, both of Germany

[73] Assignee: Parat-Werk Schonenbach GmbH & Co. KG, Remscheid, Germany

[21] Appl. No.: 181,567

[22] Filed: Jan. 14, 1994

[30] Foreign Application Priority Data

Jul. 28, 1993 [DE] Germany ..... 93 11 240.8 U

[51] Int. Cl.[6] ..... A42B 3/00

[52] U.S. Cl. ..... 2/411; 2/424; 2/425

[58] Field of Search ..... 2/410, 411, 412, 414, 2/421, 422, 423, 424, 425, 205, 171

[56] References Cited

U.S. PATENT DOCUMENTS

| | | | |
|---|---|---|---|
| 3,555,561 | 1/1971 | Neis | 2/421 |
| 4,058,854 | 11/1977 | Rhee | 2/425 |
| 4,443,891 | 4/1984 | Blomgren et al. | 2/425 |
| 5,088,130 | 2/1992 | Chiarella | 2/411 |
| 5,119,516 | 6/1992 | Broersma | 2/411 |
| 5,177,815 | 1/1993 | Andujar | 2/411 |

FOREIGN PATENT DOCUMENTS

| | | | |
|---|---|---|---|
| 3632525 | 3/1988 | Germany | 2/410 |
| 4104194 | 8/1992 | Germany | 2/421 |
| 91 03 950.9 | 10/1992 | Germany . | |
| 2220556 | 1/1990 | United Kingdom | 2/411 |

OTHER PUBLICATIONS

Freizeit & Reisen; "Die Halfte War Mangelhaft"; Test Fahrad-Schutzhelme (fur Kinder & Jugenliche); 7 pages, May 1922.

*Primary Examiner*—Clifford D. Crowder
*Assistant Examiner*—Michael A. Neas
*Attorney, Agent, or Firm*—Herbert Dubno

[57] ABSTRACT

A protective helmet for bicycles has a skeletal outer body of impact-resistant and impact-absorbing hard synthetic resin and a cushion cap within this body which substantially completely encloses the cranium of the wearer and bridges spaces between the relatively narrow bands from which the skeletal outer body is constituted. The bands include a chin band forming a ring with a occipital band, a frontal band bridging across the chin band and a saggital band centrally connecting the frontal band and the occipital band.

12 Claims, 4 Drawing Sheets

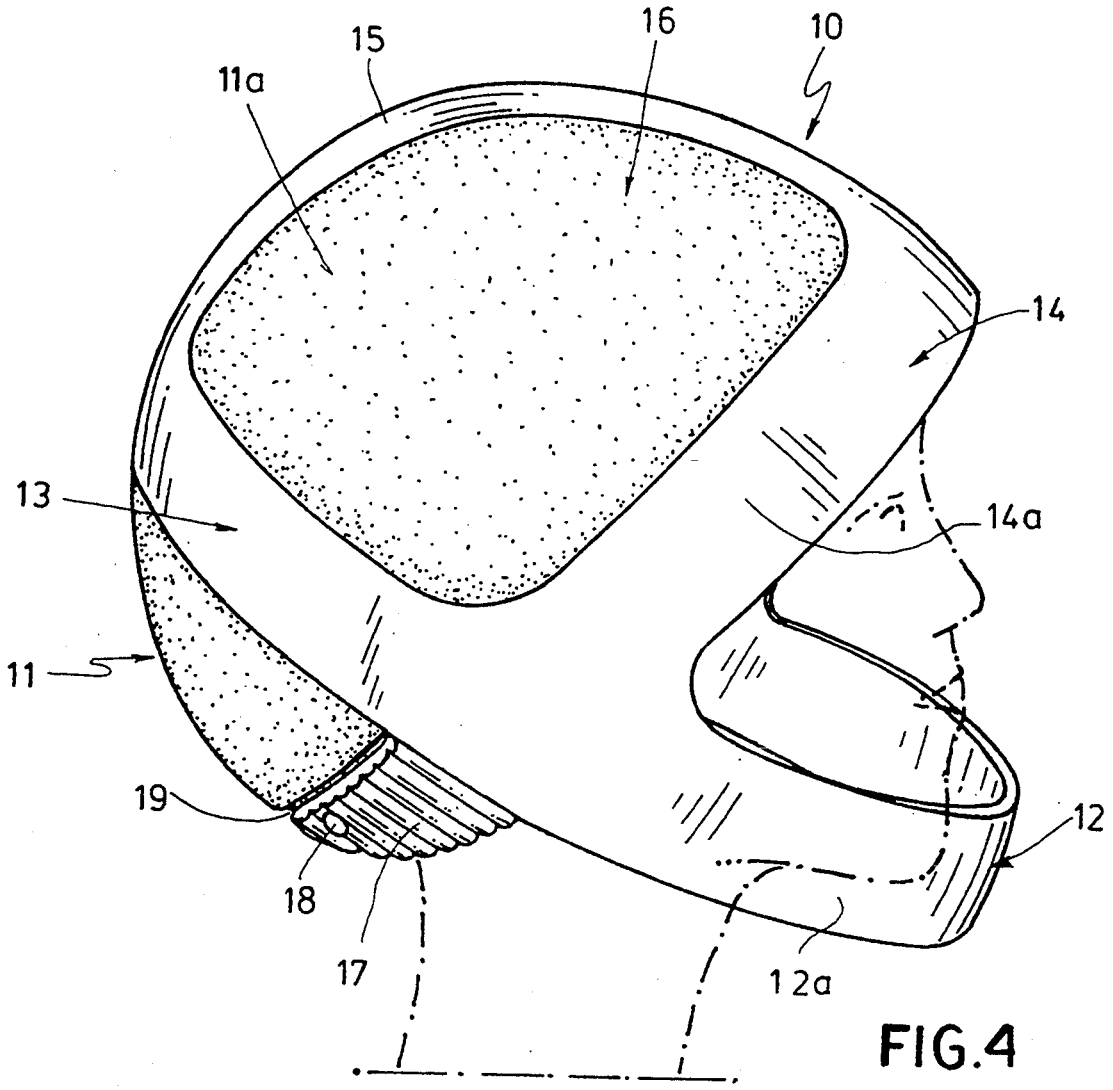
FIG.4
FIG.6
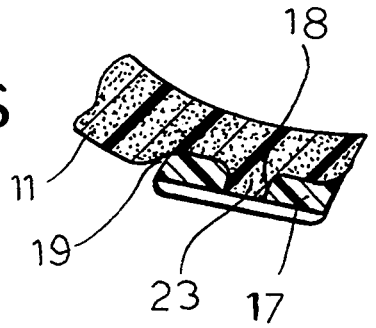

PROTECTIVE HELMET

FIELD OF THE INVENTION

The present invention relates to a protective helmet having a hard, impact-resistant outer body and a chin band formed unitarily therewith providing a protection to the chin region of the head of the user, the body being lined with an elastic inner cushion which encloses continuously the sincipital and occipital portions of the head.

BACKGROUND OF THE INVENTION

Protective helmets which enclose substantially the entire skull of a wearer from the forehead to the base of the skull and which extend around the temple regions and even over portions of the face of the wearer are widely used by motorcyclists to provide the head protection required by law in many jurisdictions as well as a safety factor. Such helmets are, however, comparatively massive and, because of their size and weight have not been found to be satisfactory by bicyclists.

The helmets available for bicyclists have generally been of three types and are customarily of significantly lower cost than the motorcycle helmets which enclose more of the head of the wearer. The so-called soft shell helmet comprises a comparatively thick, substantially incompressible and resilient hard-foam shell which is generally constituted entirely of foamed polystyrene. The soft shell helmet is the least expensive of the three types (see the journal test, May 1992, page 80).

Both the price and weight are higher for so-called hard shell helmets in which over a foamed liner a second hard plastic shell is provided which makes the helmet more robust and also makes penetration of objects into the helmet more difficult.

A compromise between the hard shell helmet and the soft shell helmet is constituted by the so-called micro-shell model in which the foam shell is covered or coated by a thin plastic covering providing a hard surface for the exterior of the helmet (see test, op. cit. page 80).

The bicycling helmets of these three types, usually do not have any chin protection and in many cases may be only cosmetic with little ability to protect the rider. In other words in some cases the helmet may provide little if any protective effect.

The function of a protective helmet depends primarily upon its construction and the material used. It is the protective function which must be paramount if the helmet is to be successful.

One of the problems, however, is that the helmet is not always acceptable for children and young riders because the helmet may shift on the head, inadvertently fall off, or simply be uncomfortable (test, op. cit. page 81). Thus the two factors of greatest importance are the reliability of the helmet from a safety point of view and the acceptance of the helmet by the user, meaning that the helmet should not shift on the head or be displaced by forcible shaking of the head or the like (see test, op. cit. page 80).

OBJECTS OF THE INVENTION

It is, therefore, the principal object of the present invention to provide a protective helmet, especially for bicyclists, which is of light weight, compact size and reliable with respect to head protection, while being free from a tendency to shift on the head of the wearer.

Another object of this invention is to provide an improved bicycling helmet which has all of the desired features outlined above and is free from drawbacks of prior art helmets.

It is another object of the invention to provide an economical bicycling helmet which is comfortable and affords a full range of protection, including protection for the entire cranial region, as well as for the chin of the user.

It is still another object of the invention to provide a protective helmet for bicyclists that is acceptable to users including children and youths.

SUMMARY OF THE INVENTION

These objects and others which will become apparent hereinafter are attained in accordance with the invention by providing a hard, impact-resistant outer body together with a chin band in the form of a one-piece skeleton-like outer part of the helmet and a liner or inner part of the foam which covers the entire cranial region. The acceptability of such a helmet derives from the unique appearance of the skeletal outer part as well as from the reduced overall weight of the helmet.

It will be understood that the helmet, whose hard skeleton covers substantially all of the important parts of the head susceptible to damage, is in principle more reliable as a protective member than a hard foam shell which may be more encompassing and cannot be considered a skeleton in the sense of the invention. The skeleton can be open in regions which are not usually subject to impact so that in these regions, only the head cushioning shell or liner is provided.

More particularly, a protective helmet adapted to fit over the head of the user comprises:

- a hard, impact resistant helmet skeleton formed in one piece from narrow bands and including:
  - a frontal band extending generally from regions below temples of the head across a frontal portion of the head,
  - an occipital band extending from the regions of the frontal band across an occipital region of the head,
  - a saggital band extending generally along the saggital suture of the head between a central portion of the occipital band to a central portion of the frontal band, and
  - a chin band extending from the regions around a chin of the head,
    - the chin band and the frontal band delimiting an opening forming a viewing field; and
- an elastic head-cushioning shell within the helmet skeleton interposed between the frontal, occipital and saggital bands and the head,
  - the shell spanning openings delimited by the frontal band, the occipital band and the saggital band,
  - the shell covering at least the sinciput and occiput of the head.

While in general terms it is not new to provide a helmet for a cyclist with a chin-protective member (see German Utility Model DE-U 91 03 950), from the point of view of weight, this system does not satisfy the requirements of cyclists generally. Furthermore, the chin band is a separate piece which must be affixed to the remainder of the helmet and displace the cross section of the parts to which it is applied. Ventilation is a problem and, in general, the acceptability of such a helmet is limited.

According to a feature of the invention, the expanded band is formed substantially as a rearward extension of the chin band and the chin band and expanded band together form a protective ring lying substantially in a plane.

The skeleton can be formed with inwardly projecting lugs effectively constituting extensions of shanks of the frontal band and engaging below a skull of the head. Means can be provided for securing the cranium-enclosing shell to the lugs.

Advantageously, the outer surface of the shell is formed with recesses complementary to and receiving the occipital, frontal and saggital bands.

The means for securing the cranium-enclosing shell to the lugs can include a hole formed in each lug and a rivet formation of the shell projecting into each of the holes.

The skeleton can be composed of a material selected from the group which consists of acrylonitrile-butadiene-styrene and polycarbonate polymers and the blends thereof and the shell can be composed of a polystyrene, polyurethane or polyethylene foam. The frontal band and the chin band can include an acute angle with one another opening forwardly.

BRIEF DESCRIPTION OF THE DRAWING

The above and other objects, features, and advantages will become more readily apparent from the following description, reference being made to the accompanying drawing in which:

FIG. 4 is a side view in the direction of arrow IV of FIG. 1;

FIG. 6 is a cross sectional view taken through one of the lugs showing the anchor of the shell in a hole thereof.

SPECIFIC DESCRIPTION

Figure 1:
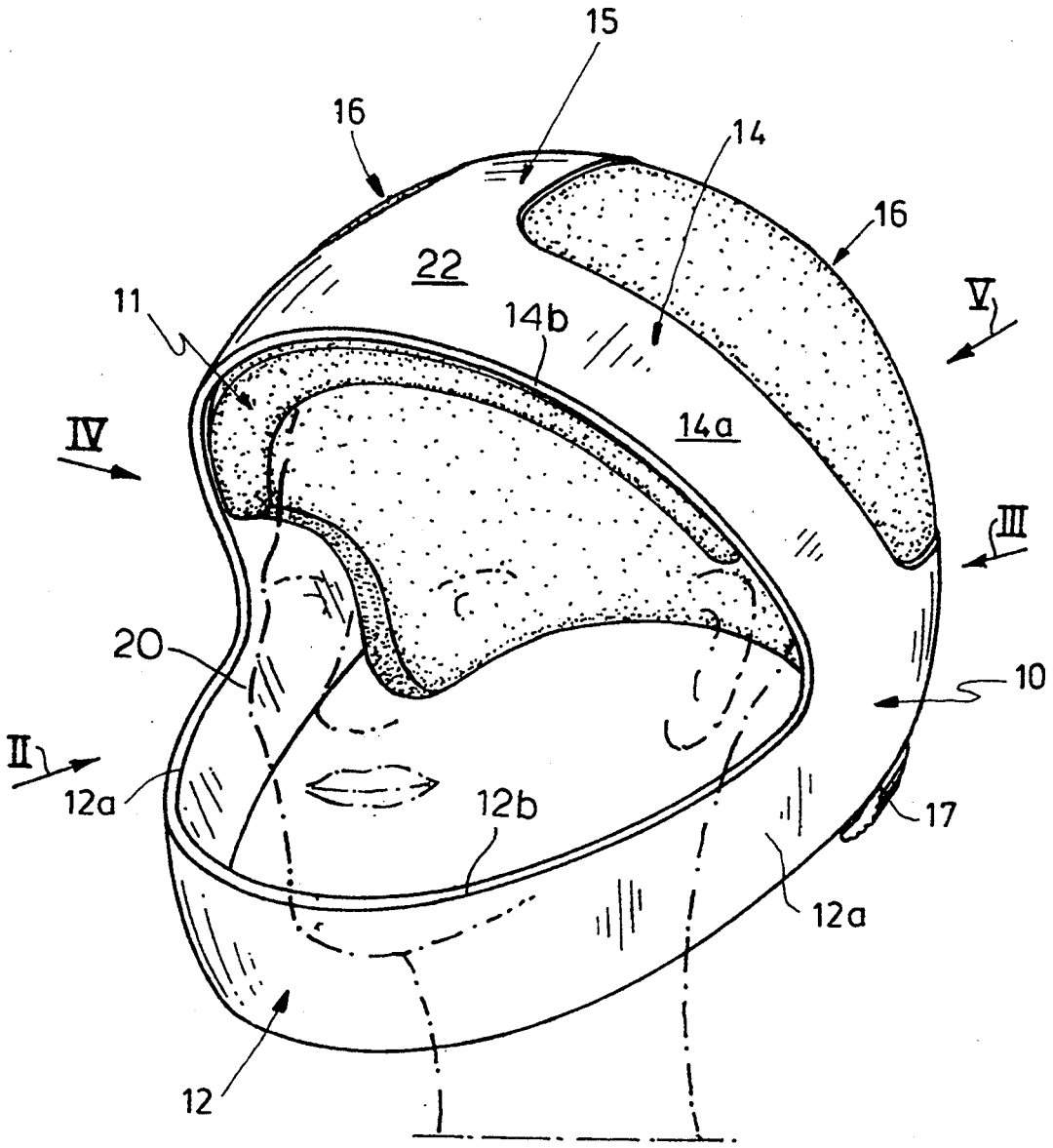
FIG. 1 is a front perspective view of a cycling helmet of the invention.
Figure 2:
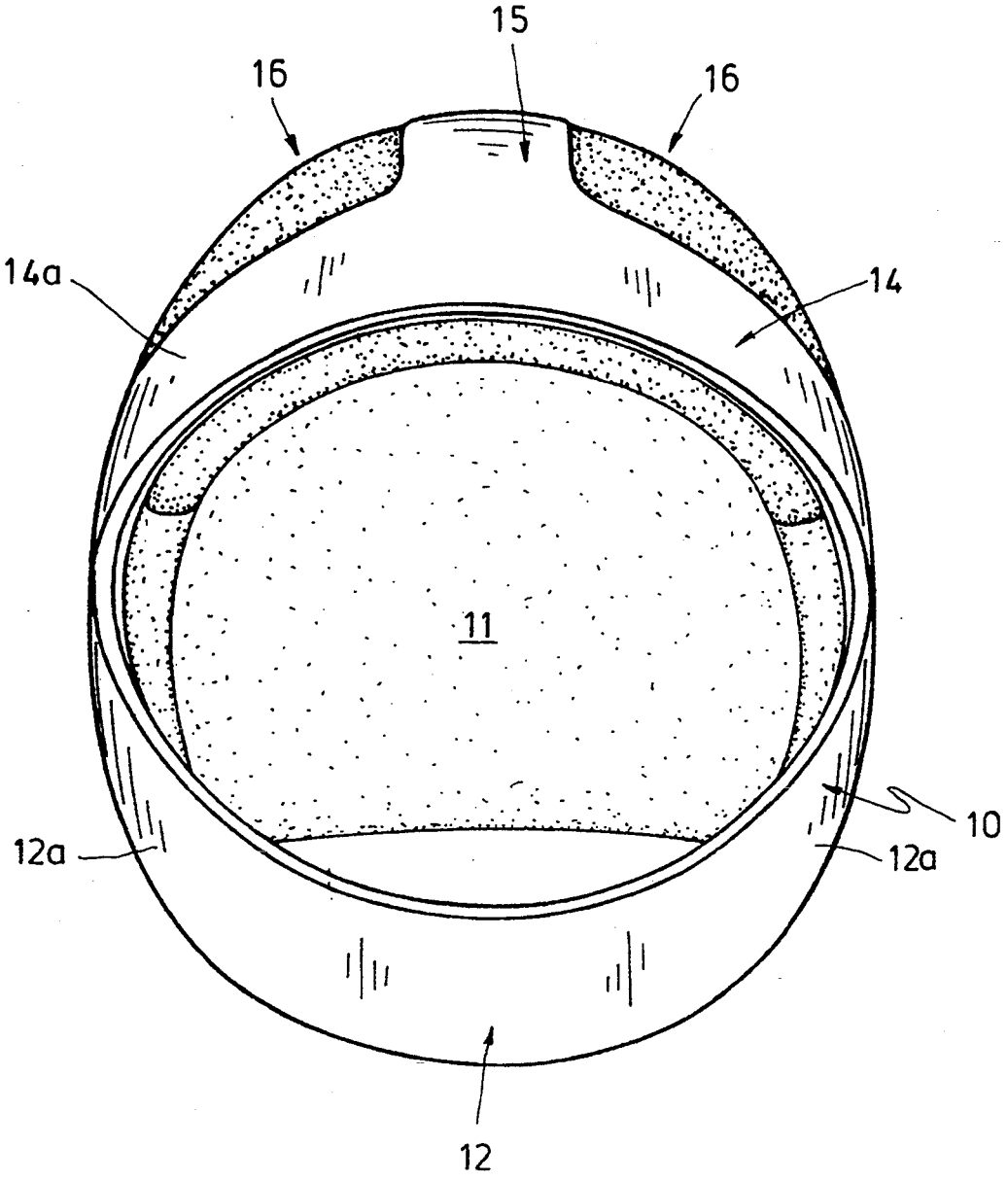
FIG. 2 is a view of the frontal portion in the direction of the arrow II of FIG. 1.
Figure 3:
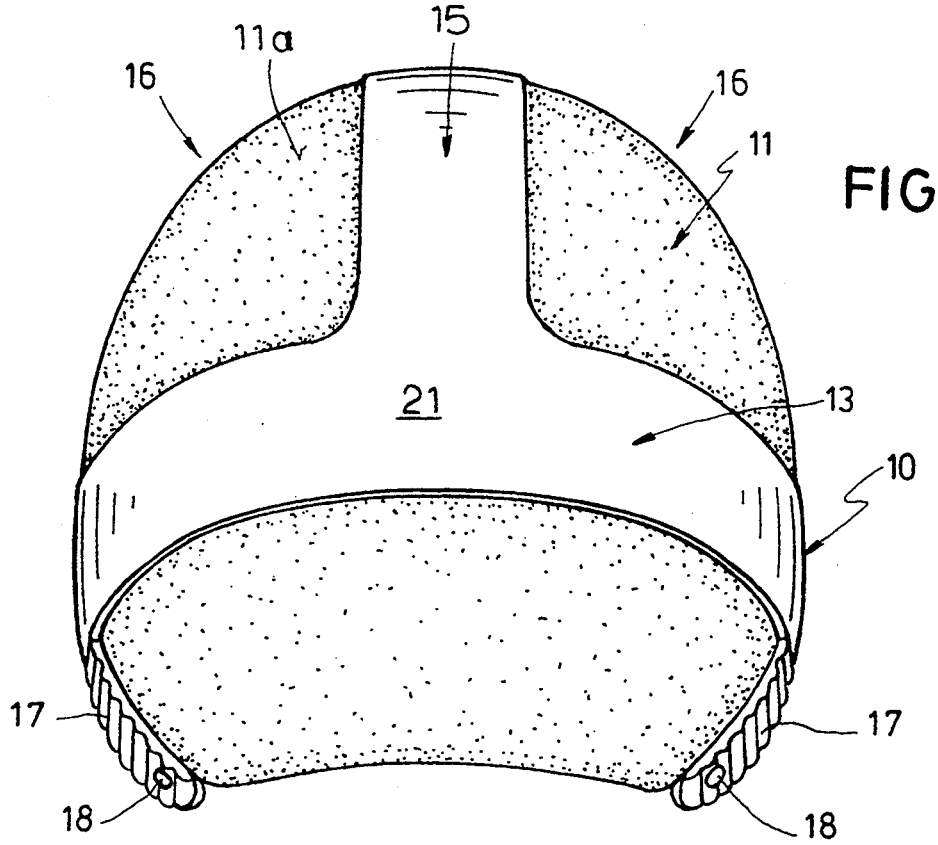
FIG. 3 is a rear view of the helmet in the direction of the arrow III of FIG. 1.
Figure 5:
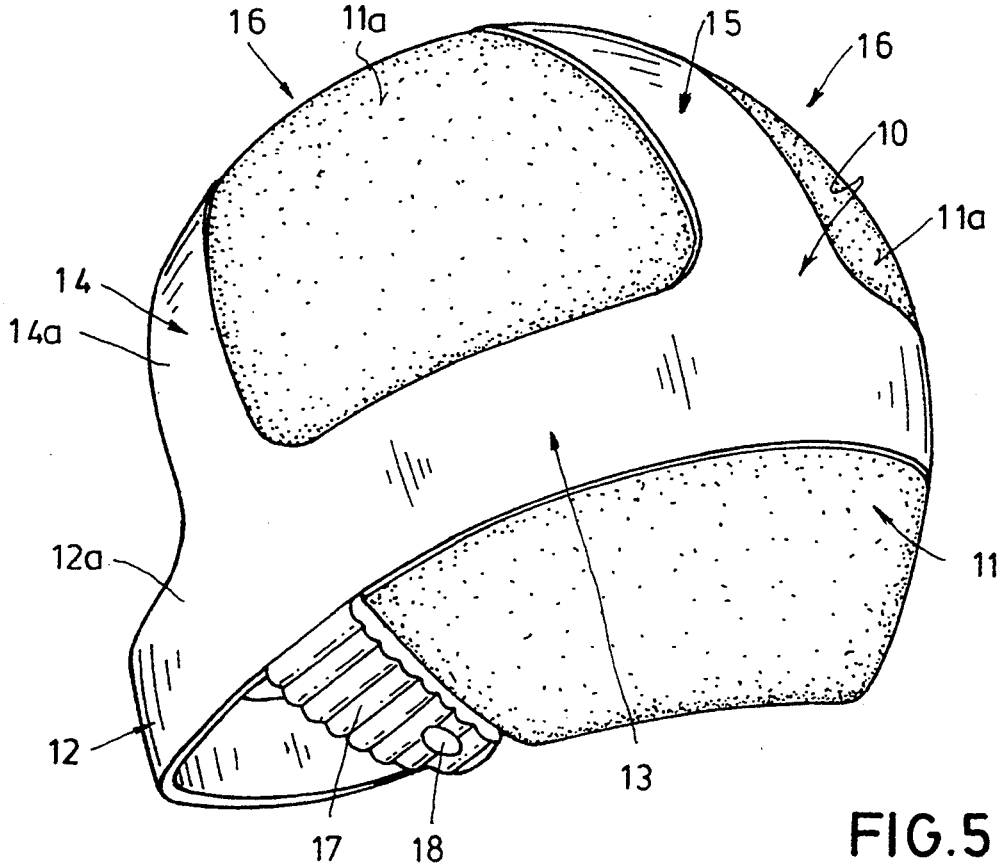
FIG. 5 is a perspective view from the rear in the direction of arrow V of FIG. 1.

The protective helmet shown in the drawing, apart from the strap which can be provided to extend under the chin and hold the helmet on the head of the wearer and can be provided with a buckle or other connector for this purpose, comprises generally an outer body 10 and an inner shell 11.

The outer body 10 is constituted of a one-piece plastic member of hard, impart-absorbing material while the inner shell 11 is an elastic cushion shaped to enclose the entire cranium of the wearer, including the sinciput and the occiput thereof. A suitable material for the outer body 10 is acrylonitrile-butadiene-styrene (i.e. terpolymer ABS), polycarbonate (PC or byblend (ABS/PC) or the like. The softer head cushion shell 11 can be composed of foamed polystyrene, a polyurethane foam, a polyethylene foam or the like.

For the invention it is important that the outer body 10 be basically a skeleton which is constituted from relatively narrow strip-like bands which adjoin one another.

These bands can include a generally semicircular chin-protective band or chin band 12, an occipital or back-of-the-head band 13 which may also be generally semicircular, a frontal band 14 adapted to extend across the forehead of the wearer and around the frontal region of the skull, and a saggital band 15 which runs generally along the saggital suture of the head between a central portion of the occipital band to a central portion of the frontal band.

The chin band 12 and the frontal band 14 lie at an acute angle to one another, opening forwardly so that between the angularly adjoining edges **12*b* and 14*b*, a window 20** is provided allowing a large field of view for the wearer.

The occipital band 13 extends from the rearwardly running lateral shanks **12*a*** to the chin band and connects these shanks to form a continuous safety ring therewith which resists impact and lies in a plane. This closed ring runs around the back of the head, the sides thereof below the ears of the wearer and around the chin.

As noted, the saggital band 15 is connected to the occipital at the center thereof in a junction 21 providing protection for the occipital region of the cranium. The saggital band 15 extends forwardly from this region across the zenith of the head and then forwardly toward the junction 22 with the frontal band 14.

Two large generally triangular spaces 16 are thus delimited by the frontal, occipital and saggital bands symmetrically on opposite sides of the saggital band and bridged only by material of the head cushion shell 11.

The hard, impact-resistant but impact-absorbing material of the outer body skeleton covers, however, all of the most important parts of the head including the ears, temples, forehead regions, occipital or back of the head region and, of course, the saggital region.

To secure the outer body 10 with the softer head cushion 11, downwardly and inwardly extending lugs 17 are provided (see FIG. 4) to engage below the back of the head. These lugs are provided generally as extensions of the lateral shanks **14*a* of the frontal band 14 and can follow the head curvature inwardly. The lugs 17 are formed in one piece with and of the same material as the outer body 10. The lugs may not be flexible or may only be limitedly flexible and because they engage behind and beneath the cushion 11, serve to retain this cushion in the skeletal outer body 10. Material of the cushion can extend through openings in the lugs 17, e.g. as the protuberances 23 in the holes 18 (FIG. 6) as an additional attachment means. Alternatively, rivets through the holes 18 can be provided to anchor the cushion 11 to the lugs 17**.

The outer surfaces **11*a* of the cushion shell 11 can, as represented at 19, be recessed complementarily to the parts of the skeletal outer body 10 received therein, i.e. in the shape of strips of the same widths of the band, to provide an additional formfitting connection between the body 10 and 11. Where the parts 10 and 11** are immediately juxtaposed, they can also be cemented or glued together or thermally welded together.

The protective helmet of the invention has been found to be capable of protecting the wearer against accidents involving head impact. The zones which are most susceptible to such impact are protected by the skeletal outer body which is cushioned with respect to the cranium. Nevertheless the amount of material in the helmet has been reduced to a minimum so that a high degree of protection can be obtained with an unusually light weight helmet construction which is comfortable to wear. This comfort to the wearer combined with its esthetic configuration has made the helmet unusually acceptable and thus can ensure that the wearer will effectively utilize the helmet in cycling.

We claim:

1. A protective helmet adapted to fit over a head of a user, comprising:

a hard, impact resistant helmet skeleton formed in one piece from narrow bands and including:

a frontal band extending generally from regions below temples of the head across a frontal portion of the head, an occipital band extending from said regions of said frontal band across an occipital region of the head, a saggital band extending generally along the saggital suture of the head between a central portion of said occipital band to a central portion of said frontal band, and a chin band extending from said regions around a chin of the head, said chin band and said frontal band delimiting an opening forming a viewing field; and an elastic head-cushioning shell within said helmet skeleton interposed between said frontal, occipital and saggital bands and the head, said shell completely spanning openings delimited by said frontal band, said occipital band and said saggital band, said shell covering at least the sinciput and occiput of the head.

2. The protective helmet defined in claim 1 wherein said occipital band is formed substantially as a rearward extension of said chin band and said chin band and occipital band form a protective ring lying substantially in a plane.

3. The protective helmet defined in claim 1 wherein said skeleton is formed with inwardly projecting lugs substantially formed as extensions of shanks of said frontal band and engaging below a base of a skull of the head.

4. The protective helmet defined in claim 3, further comprising means for securing said head-cushioning shell to said lugs.

5. The protective helmet defined in claim 1 wherein an outer surface of said shell is formed with recesses complementary to and receiving said occipital, frontal and saggital bands.

6. The protective helmet defined in claim 5 wherein said skeleton is formed with inwardly projecting lugs substantially formed as extensions of shanks of said frontal band and engaging below a base of a skull of the head.

7. The protective helmet defined in claim 6 wherein said recesses include recesses complementary to and receiving said lugs.

8. The protective helmet defined in claim 7, further comprising means for securing said head-cushioning shell to said lugs.

9. The protective helmet defined in claim 8 wherein said means for securing includes a hole formed in each lug and a rivet formation of said shell projecting into each of said holes.

10. The protective helmet defined in claim 9 wherein said occipital band is formed substantially as a rearward extension of said chin band and said chin band and occipital band form a protective ring lying substantially in a plane.

11. The protective helmet defined in claim 10 wherein said skeleton is composed of a material selected from the group which consists of acrylonitrile-butadiene-styrene, polycarbonate and blends thereof, and said shell is composed of a material selected from the group which consists of polystyrene, polyurethane, and polyethylene foam.

12. The protective helmet defined in claim 11 wherein said frontal band and said chin band include an acute angle with one another opening forwardly.

* * * * *